US008347936B2

(12) United States Patent
Martin et al.

(10) Patent No.: US 8,347,936 B2
(45) Date of Patent: Jan. 8, 2013

(54) HYBRID MOUNT ASSEMBLY FOR A WINDOW TREATMENT

(75) Inventors: Carolyn M. Martin, Providence, RI (US); Michael P. Hanley, Smithfield, RI (US)

(73) Assignee: Kenney Manufacturing Co., Warwick, RI (US)

( * ) Notice: Subject to any disclaimer, the term of this patent is extended or adjusted under 35 U.S.C. 154(b) by 164 days.

(21) Appl. No.: 12/829,799

(22) Filed: Jul. 2, 2010

(65) Prior Publication Data

US 2010/0269987 A1 Oct. 28, 2010

Related U.S. Application Data

(63) Continuation-in-part of application No. 29/362,812, filed on Jun. 1, 2010, now Pat. No. Des. 637,854.

(60) Provisional application No. 61/223,914, filed on Jul. 8, 2009, provisional application No. 61/332,349, filed on May 7, 2010, provisional application No. 61/332,354, filed on May 7, 2010, provisional application No. 61/348,413, filed on May 26, 2010.

(51) Int. Cl.
*A47H 5/00* (2006.01)

(52) U.S. Cl. ..... 160/84.01; 160/84.04

(58) Field of Classification Search ..... 160/84.01, 160/84.04, 84.06, 170, 171; 248/254, 257–260
See application file for complete search history.

(56) References Cited

U.S. PATENT DOCUMENTS 1,133,033 A * 3/1915 Jarvey ..... 248/254
1,564,328 A * 12/1925 Cutting ..... 160/112
1,712,455 A * 5/1929 Connolly ..... 160/309
2,139,950 A * 12/1938 Galley ..... 160/207
2,233,430 A * 3/1941 Ratcliffe ..... 248/254
2,474,434 A * 6/1949 Mentz ..... 160/112
3,371,700 A * 3/1968 Romano ..... 160/84.01
3,389,738 A * 6/1968 Roth ..... 160/120
3,487,875 A * 1/1970 Harman et al. ..... 160/84.01
3,817,309 A * 6/1974 Takazawa ..... 160/84.01
4,205,816 A * 6/1980 Yu ..... 248/266
4,397,346 A * 8/1983 Chumbley et al. ..... 160/84.01
4,848,432 A * 7/1989 Connolly ..... 160/178.1 R
4,934,435 A * 6/1990 Regev ..... 160/84.04
6,116,319 A * 9/2000 Simon ..... 160/84.01
6,192,960 B1 * 2/2001 Simon ..... 160/84.06
6,481,487 B2 * 11/2002 Simon ..... 160/84.06
2002/0062931 A1 * 5/2002 Allsopp ..... 160/168.1 R
2004/0103995 A1 * 6/2004 Nien ..... 160/170
2004/0200583 A1 * 10/2004 Nien ..... 160/177 R
2010/0294438 A1 * 11/2010 Kirby et al. ..... 160/84.04

* cited by examiner

OTHER PUBLICATIONS

PCT/US2010/040934 International Preliminary Report on Patentability, including written opinion: Jan. 10, 2012 (5 pages). PCT/US2010/040934 International Search Report: Sep. 1, 2010 (2 pages).

*Primary Examiner* — David Purol
(74) *Attorney, Agent, or Firm* — C. Nessler; J. Stockwell

(57) ABSTRACT

A window covering for a window having a window casement, or other opening in a wall, such as a doorway or a case-less window opening, with an inside portion adjacent to the window and an outside portion adjacent to the inside portion, the outside portion having a left side portion and a right side portion is disclosed. The window covering comprising includes a support assembly configured and arranged to attach to an inside portion of a window casement and a window treatment suspended from the support assembly and overlapping at least a portion of a left side portion and a right side portion of an outside portion of the window casement whereby the window treatment covers the window.

10 Claims, 19 Drawing Sheets

HYBRID MOUNT ASSEMBLY FOR A WINDOW TREATMENT

This application is a continuation in part of U.S. Design patent application Ser. No. 29/362,812, filed on Jun. 1, 2010 now U.S. Pat. No. D637,854. This application claims benefit of U.S. Provisional Patent Applications: No. 61/223,914, filed on Jul. 8, 2009; No. 61/332,349, filed on May 7, 2010, 61/332,354, filed on May 7, 2010; and No. 61/348,413, filed on May 26, 2010, the entire contents of all of which are incorporated herein by reference.

FIELD OF THE INVENTION

The present invention relates generally to window treatments and more particularly to a hybrid mounting assembly for window treatments, such as a cordless roll-up shade.

BACKGROUND

Window treatments having cords to raise and lower the window treatment are well known in the art. However, these prior-art corded window treatments suffer from the disadvantage of exposing children and animals to a potential strangulation hazard. In particular, it is well documented that children or animals can become caught in the cords and be strangled. Various regulations and methods have been adopted to reduce the potential of strangulation to occur, such as using detachable cords and cords that have no continuous loops. However, the potential of strangulation is so great that it is desirable to produce a window treatment that lacks cords entirely, yet can still be mechanically raised and lowered. Therefore, there is a need in the art for a window treatment that lacks cords to adjust the height of the window treatment.

Also, window treatments that are suspended from brackets that are attached to a wall surrounding a window opening are well known in the art. The prior art brackets are often configured to attach to in two different ways: (a) to the wall which faces the interior space of the structure, and since such wall is outside of the window opening, it is referred to as an "outside mount," or (b) a within the recess the window opening, which is referred to as an "inside mount." However, these prior art systems suffer from a couple of disadvantages. Outside mount assemblies necessarily space the window treatment away from the plane of the wall or window frame, which makes the window treatment drafty and less heat efficient. Inside mount assemblies are limited by the width of the window opening because the window treatment is also within the confines of the window opening, and disadvantageously permit light and draft to pass by the sides of the window treatment.

Accordingly, there is a perceived need in the industry for a method of mounting a window treatment in a window opening that permits the window treatment to overlap the sides of the window opening like an outside mount, yet is nearly flush with the window opening like an inside mount.

SUMMARY OF THE INVENTION

The present invention solves the problems of the prior art by providing a cordless roll-up shade that eliminates the use of cords to raise and lower the shade. Specifically, the shade includes a lifting member attached to a roll-up shade rod which is part of a support assembly that preferably includes two brackets. The brackets are configured to be affixed to a portion of wall which extends inwardly to define the recess of a window opening, with or without an optional head rail. The lifting member is connected to the lower end of the rear face of a decorative front panel, such as a Roman shade. A wand is configured and arranged to drive the shade rod.

Another embodiment of the present invention comprises a hybrid mounting assembly having a pair of brackets that are mounted on an inward-facing portion of structure which defines the window opening. A head rail assembly attaches to the brackets and extends left-right beyond the outside edges of the opening. A window treatment is suspended from the head rail.

An objective of the present invention is the provision for a hybrid mounting assembly to permit a window treatment that is wider than the window to be mounted nearly flush with the vertical wall within which is the window opening.

Another objective of the present invention is the provision for a hybrid mounting assembly that is mounted on the portion of inward-facing structure which defines the recess of the window opening yet permits attachment of a wider window treatment to the mounting assembly.

Yet another objective of the present invention of the provision for a hybrid mounting assembly that includes a head rail that is wider than the window, yet still permits a nearly flush mount of a window treatment to the head rail.

Another provision of the present invention is the inclusion of a handle that includes a cleat to engage the handle, thereby preventing the handle from rotating. The cleat also has the added advantage to preventing the handle from wandering or swinging as well.

These and other features, aspects, and advantages of the present invention will become better understood with reference to the following description, appended claims, and accompanying drawings where:

DESCRIPTION OF PREFERRED EMBODIMENTS

Figure 1:
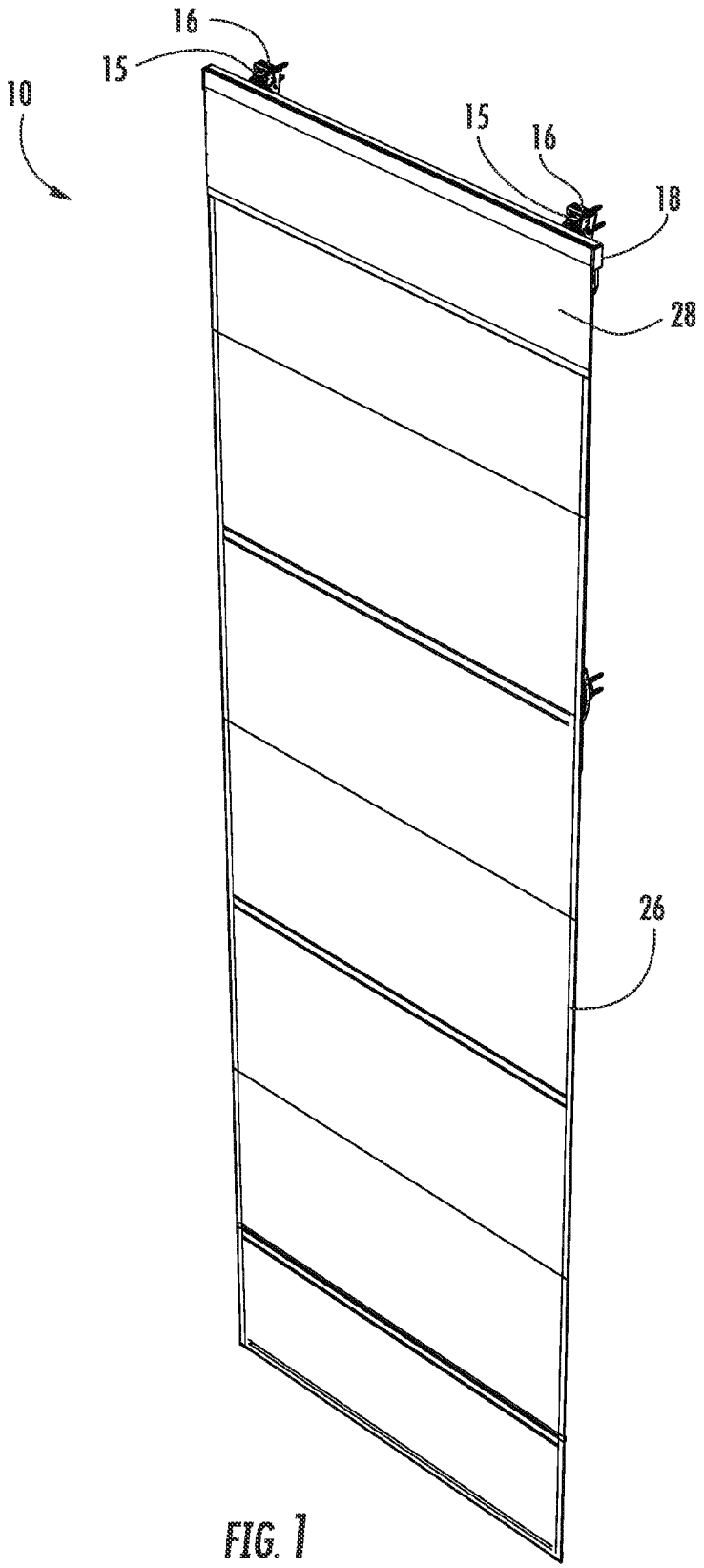
FIG. 1 is a front perspective view of an embodiment of a cordless roll-up shade of the present invention.
Figure 2:
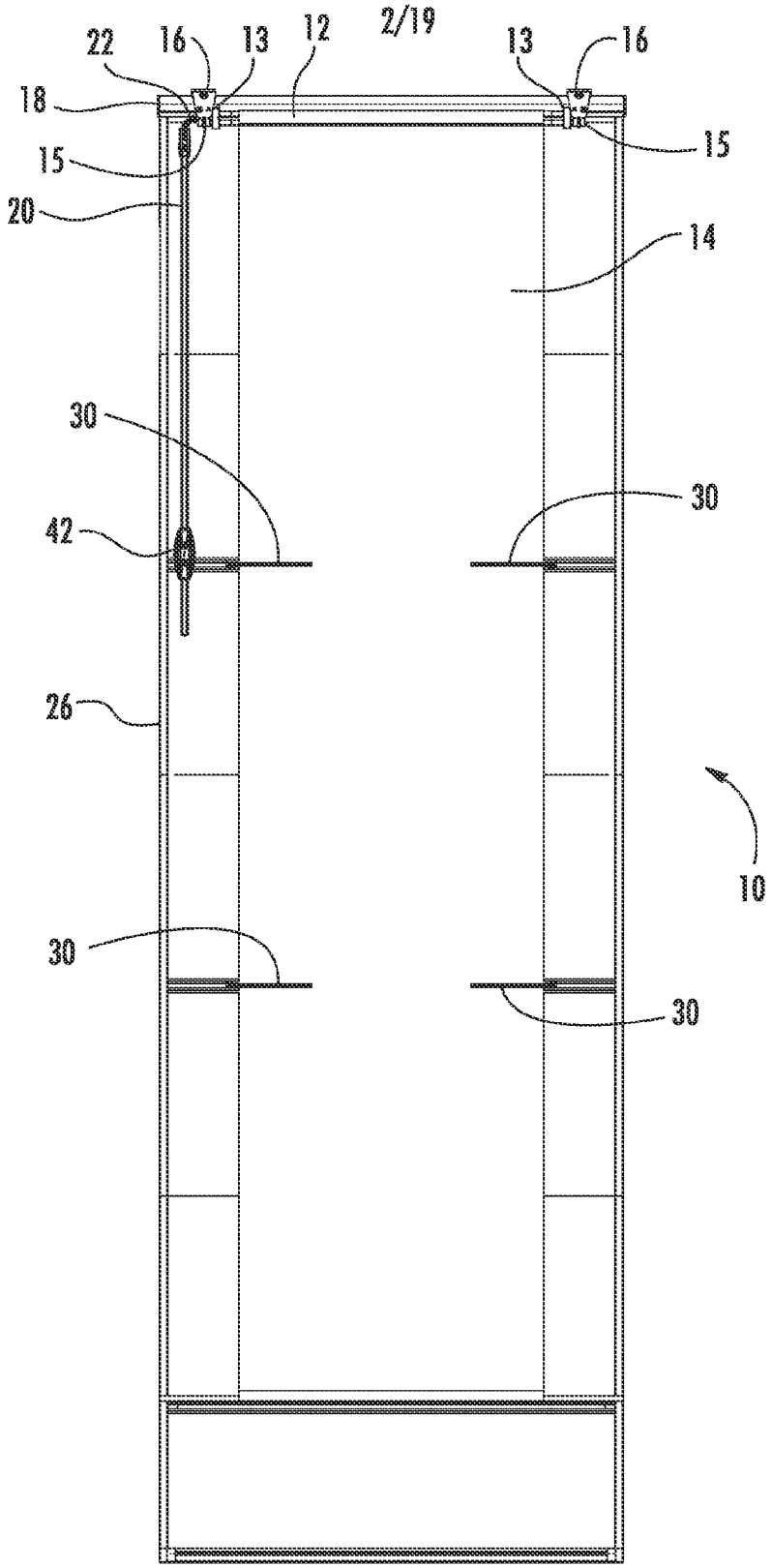
FIG. 2 is a rear view of an embodiment of the cordless roll-up shade of the FIG. 1 embodiment.
Figure 3:
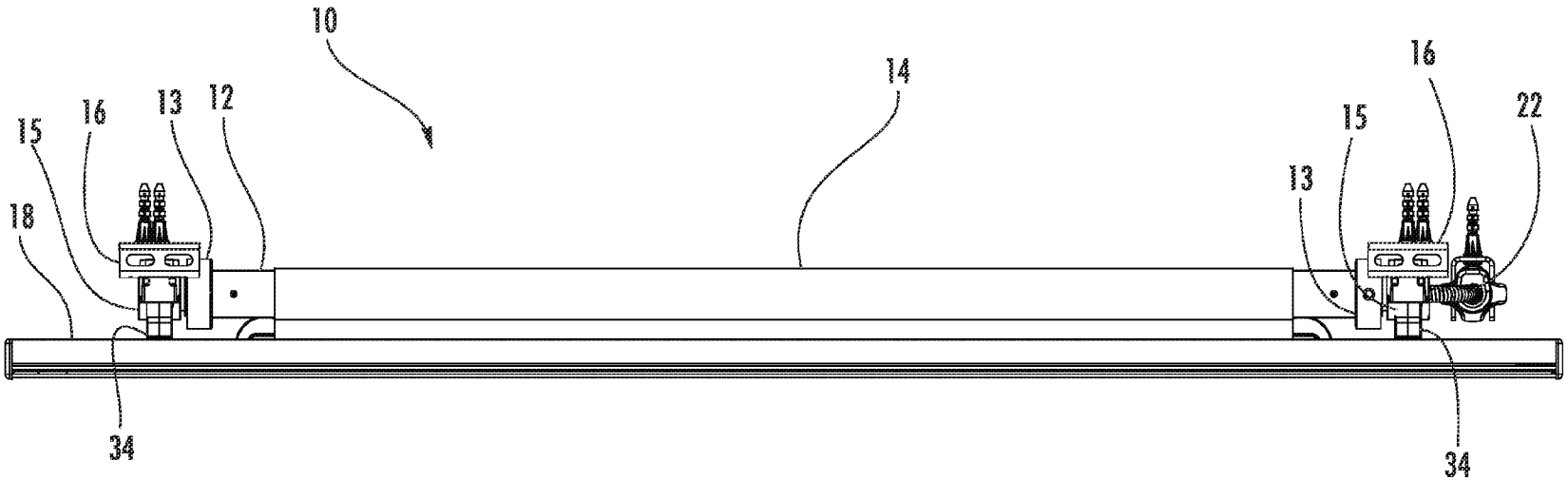
FIG. 3 is a top view of an embodiment of the cordless roll-up shade of the FIG. 1 embodiment.
Figure 4:
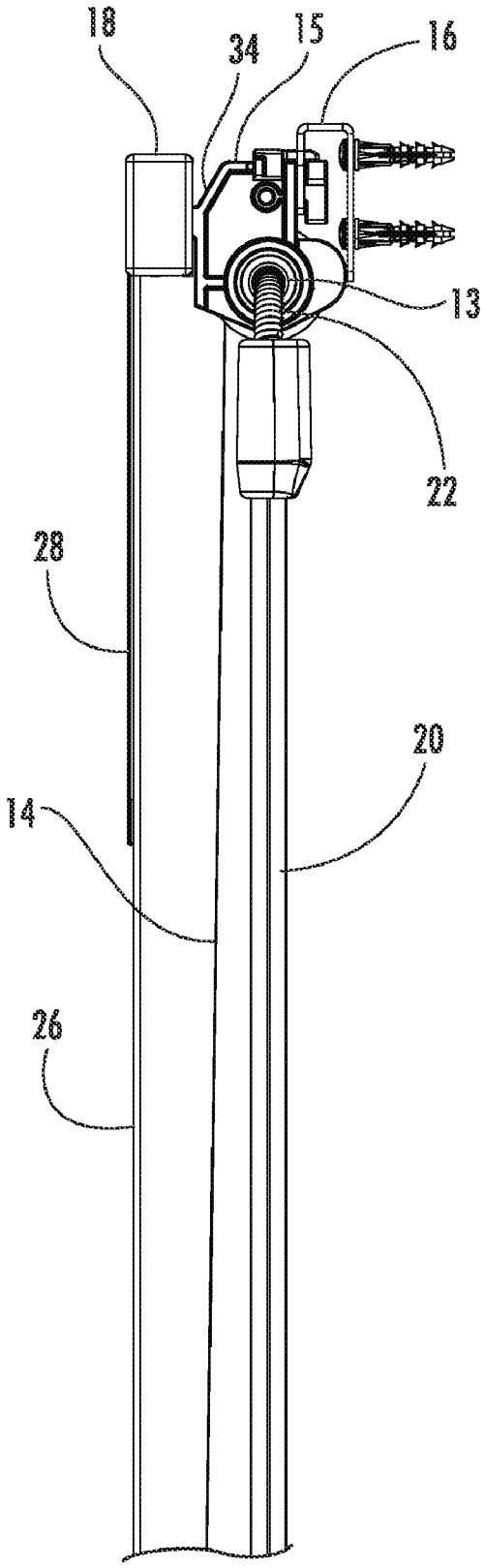
FIG. 4 is a partial left side view of an embodiment of the cordless roll-up shade of the FIG. 1 embodiment.

Referring now to FIGS. 1-4, an embodiment of the cordless roll-up shade of the present invention is shown generally at 10. The cordless roll-up shade includes a take up member, such as a shade rod 12. Wrapped about the shade rod 12 is a back panel 14, or lifting member, which raises the front panel 26 as further described below. The back panel 14 is preferably narrower than the front panel 26, but could be as wide or wider than the front panel 26. The back panel 14 may be made of any light flexible material that can be wound about the shade rod, such as mesh, cloth, fabric, polyester, nylon, polyester mesh, nylon mesh, silk, plastic, vinyl, and combinations and blends thereof. The back panel 14 may also be of different widths provided it is sufficiently wide enough to avoid being a strangulation hazard as cords are prone to being. For example, narrower ribbons of material may be used as the back panel 14.

The shade rod 12 is attached to a support assembly. Specifically, the shade rod 12 may include tube end connectors 13 held in a pair of opposing bearing blocks 15. The shade rod 12 is configured and arranged to rotate within the bearing blocks 15. The bearing blocks 15 or tube end connectors 13 may have bushings to permit the shade rod 12 to rotate more freely and smoothly. The bearing blocks 15 are supported by a pair of brackets 16.

Figure 5A:
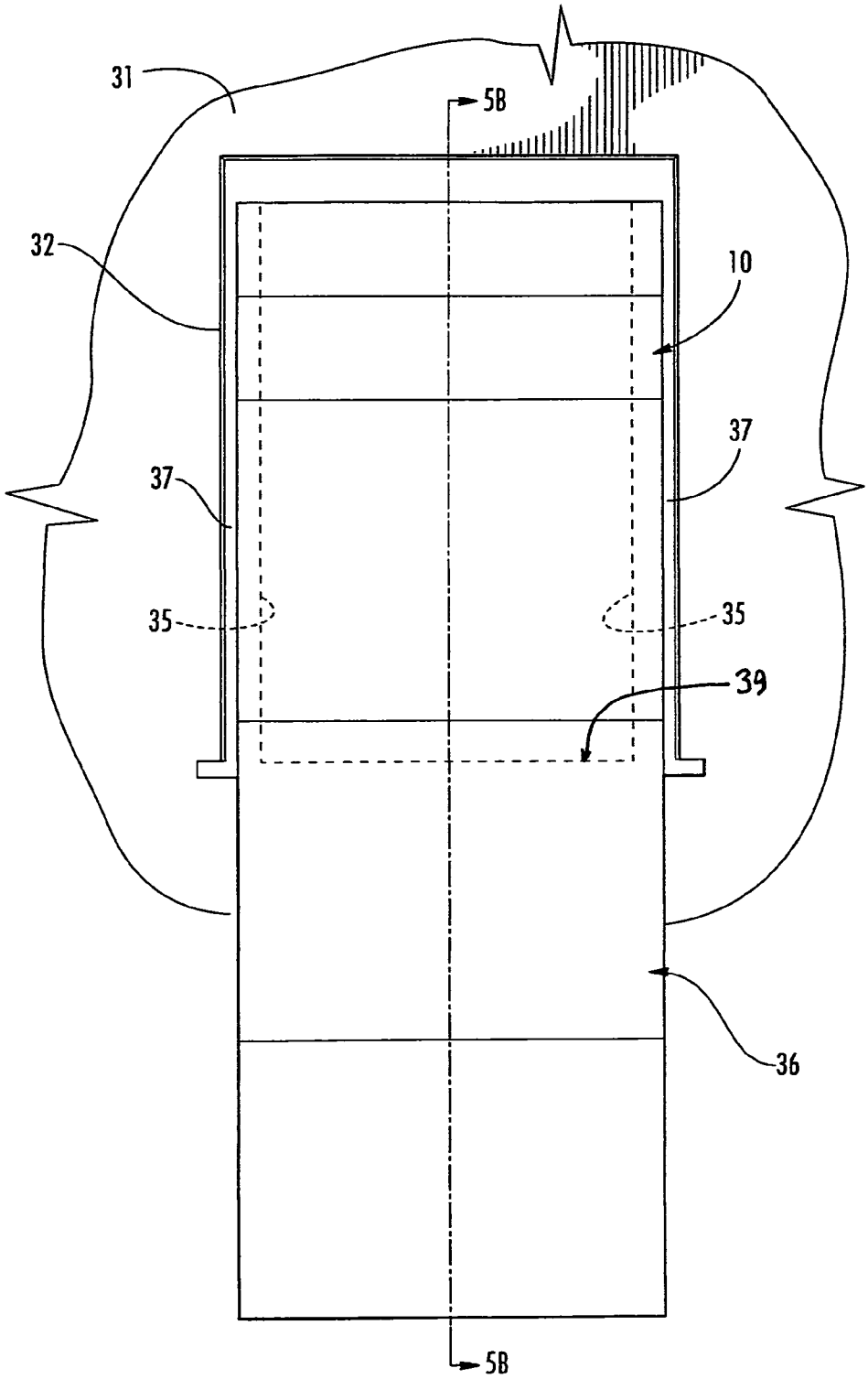
FIG. 5A is a front view of an embodiment of the cordless roll-up shade of the present invention mounted within a window opening.
Figure 5B:
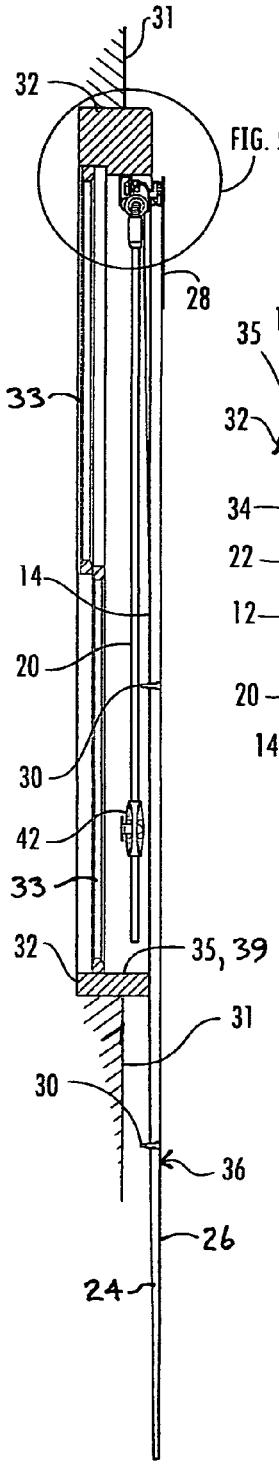
FIG. 5B is a left side cross-section view through line 5B-5B of the embodiment of FIG. 5A, showing a head rail affixed to brackets and support assembly which are set within the window opening.
Figure 5C:
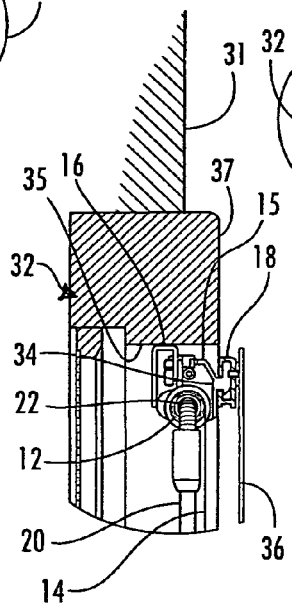
FIG. 5C is a close up view of a portion of the assembly shown in FIG. 5B.
Figure 5D:
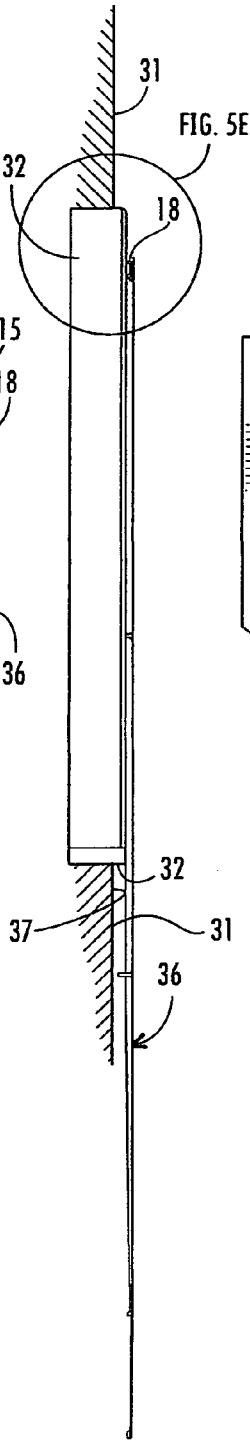
FIG. 5D is a left side view of an embodiment of the cordless roll-up shade of the present invention mounted within a window opening
Figure 5E:
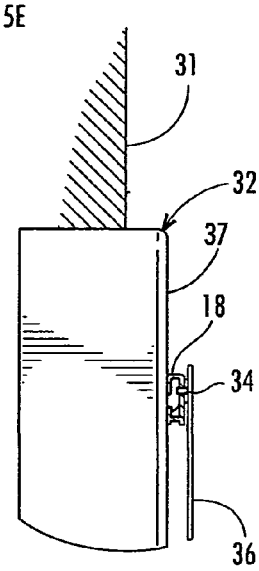
FIG. 5E is a close up view of a portion of the assembly shown in FIG. 5D.
Figure 6:
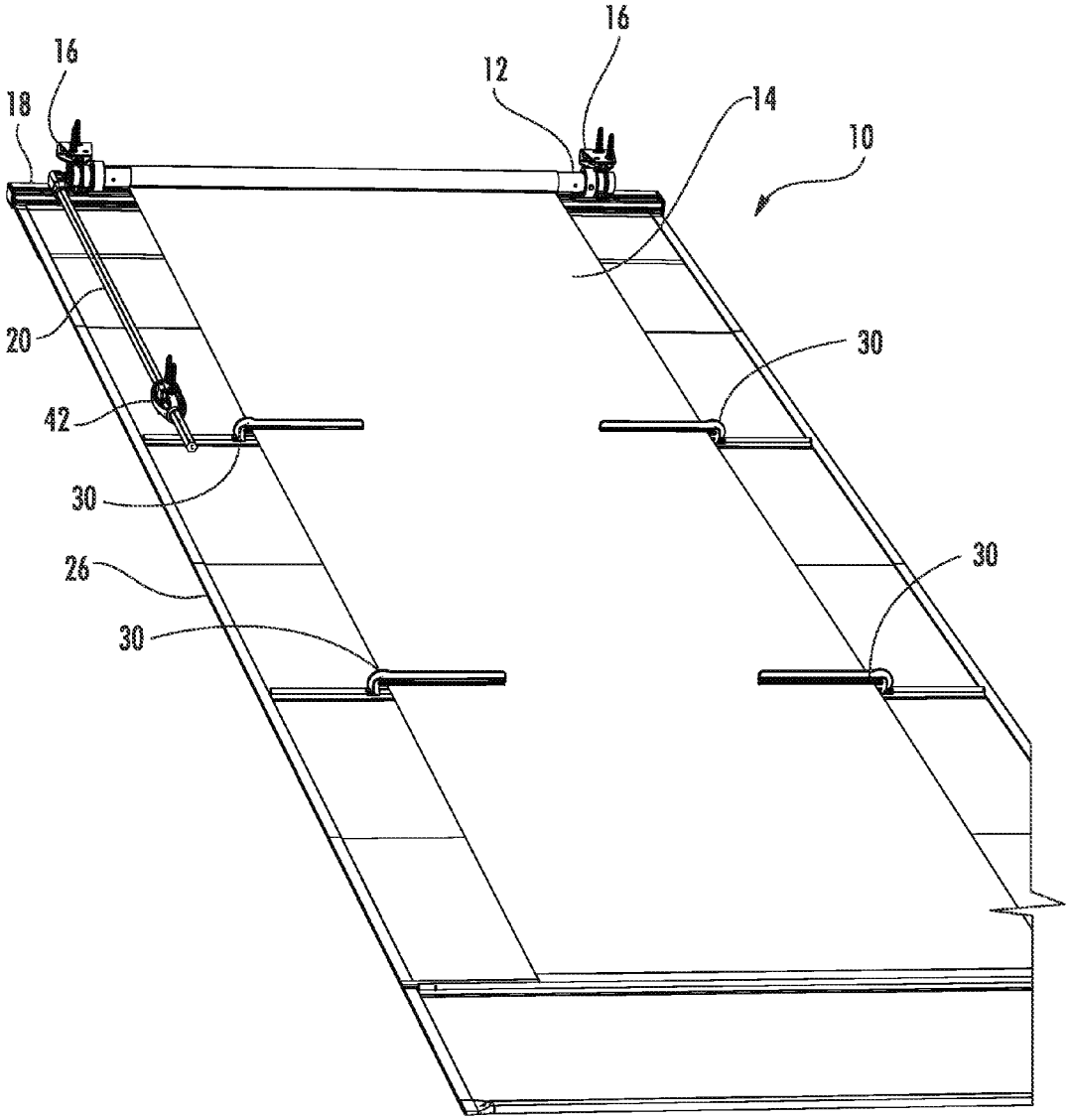
FIG. 6 is a rear perspective view of an embodiment of the cordless roll-up shade of the present invention.

FIG. 5A through FIG. 5E show Roman shade assemblies mounted on a frame 32 which defines a window opening 39 in a vertical wall having an inside surface 31. A window sash 33, which is spaced apart from the plane of vertical wall 31 and the plane of the front face 37 of frame 32 is shown in FIG. 5B and FIG. 5C. The brackets 16 are configured to be mounted to an inward-facing portion 35 of frame 32 one of four inward-running portions 35 which define the top, bottom and sides of the window opening. The brackets may be attached using fasteners, such as screws, nails or bolts. The brackets 16 may be configured to mount horizontally, vertically or at another angle to a frame portion 35. Additional spacers and braces may be used to support the brackets 16. As shown, particularly in FIG. 5C, the head rail 18 and bearing blocks are attached to the brackets, and the front panel is attached to the head rail. Alternatively, head rail 18 may be used to hold the brackets 16 within the recess of window opening. The head rail 18 may also be used to secure the front panel 26 to the wall or window frame. See FIGS. 5D and 5E.

Figure 7:
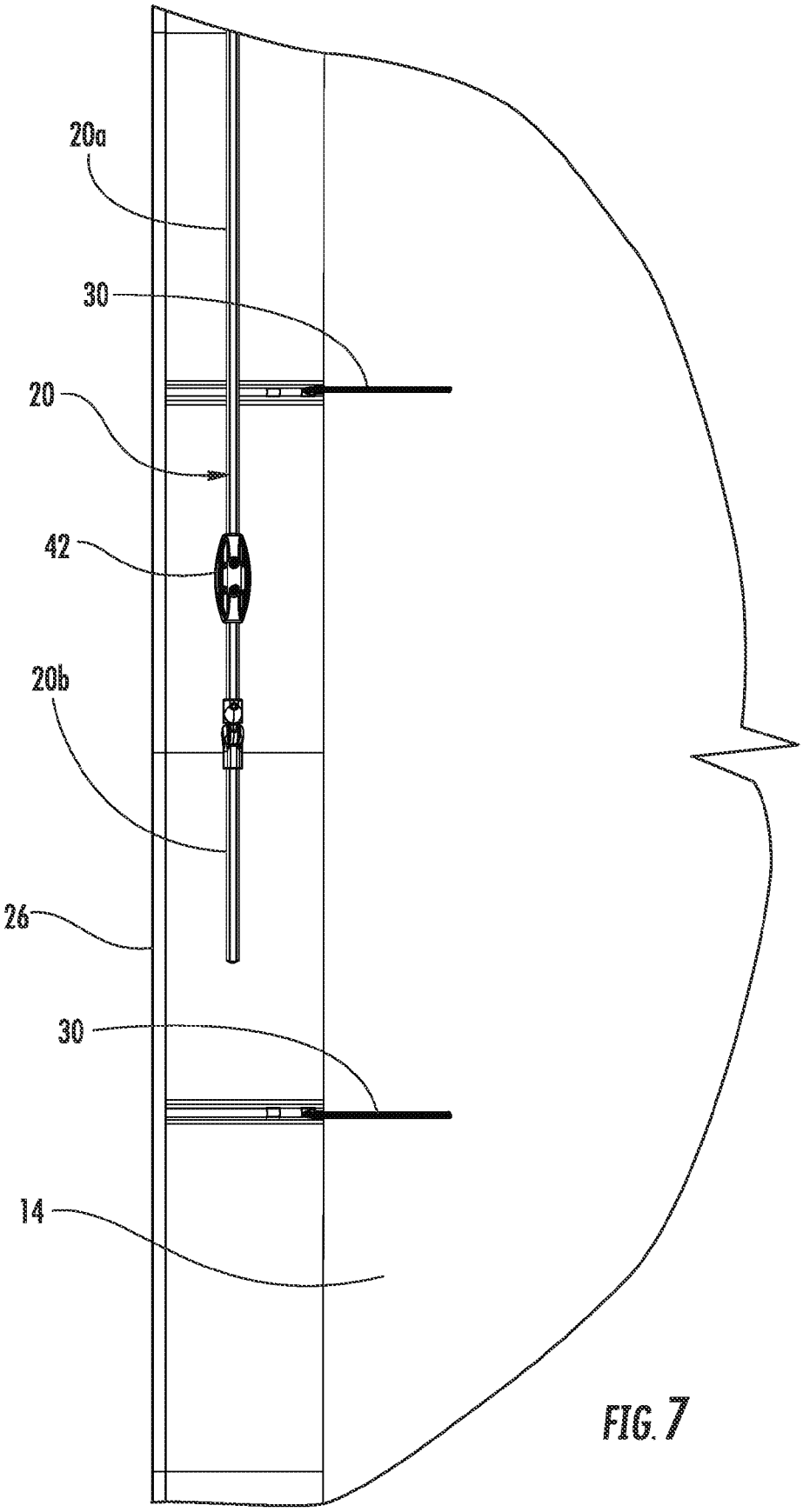
FIG. 7 is a partial rear view of an embodiment of the cordless roll-up shade of the present invention showing the wand.
Figure 8:
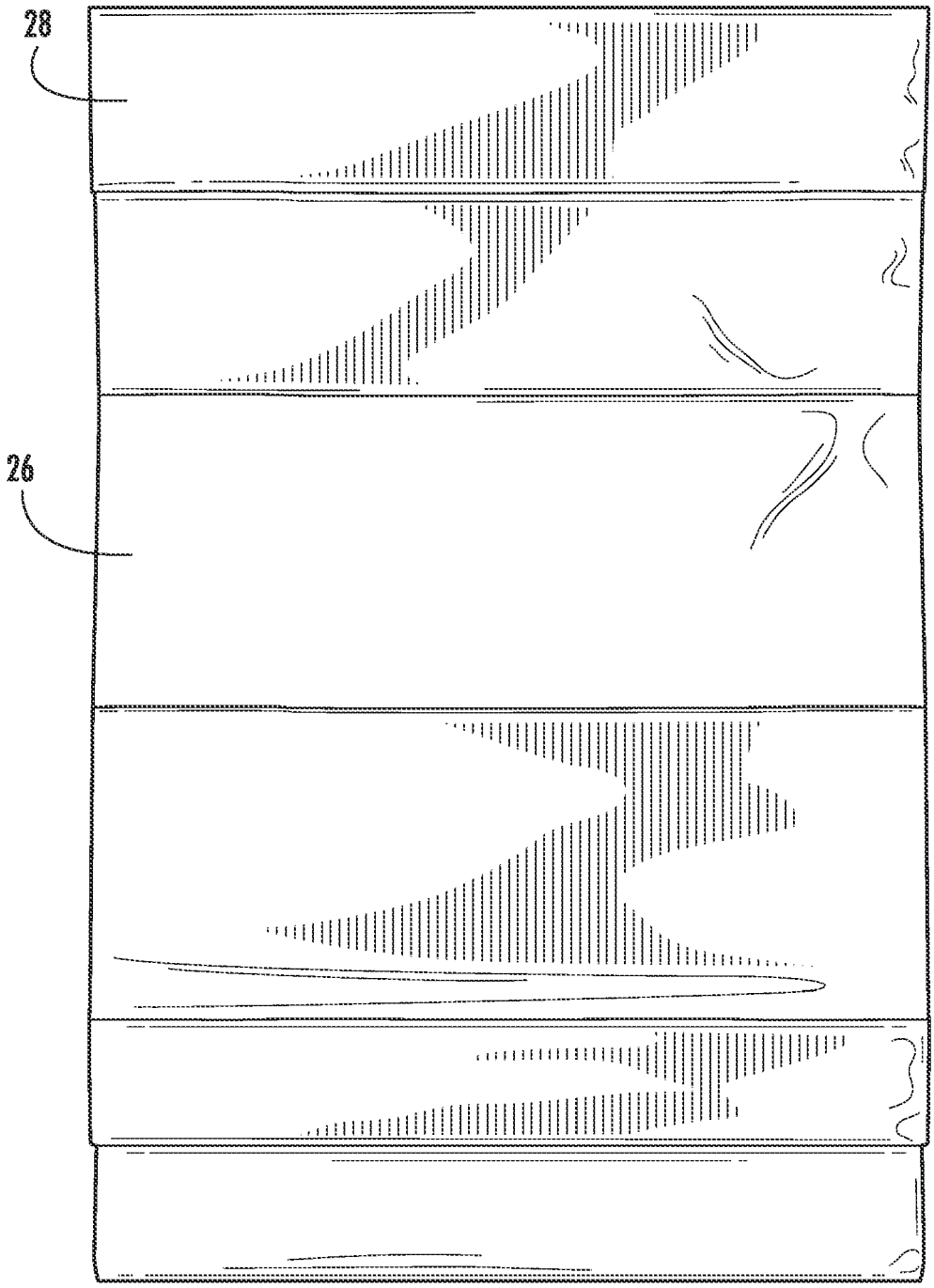
FIG. 8 is a front view of an embodiment of the cordless roll-up shade of the present invention with the decorative front panel partially rolled up.
Figure 9:
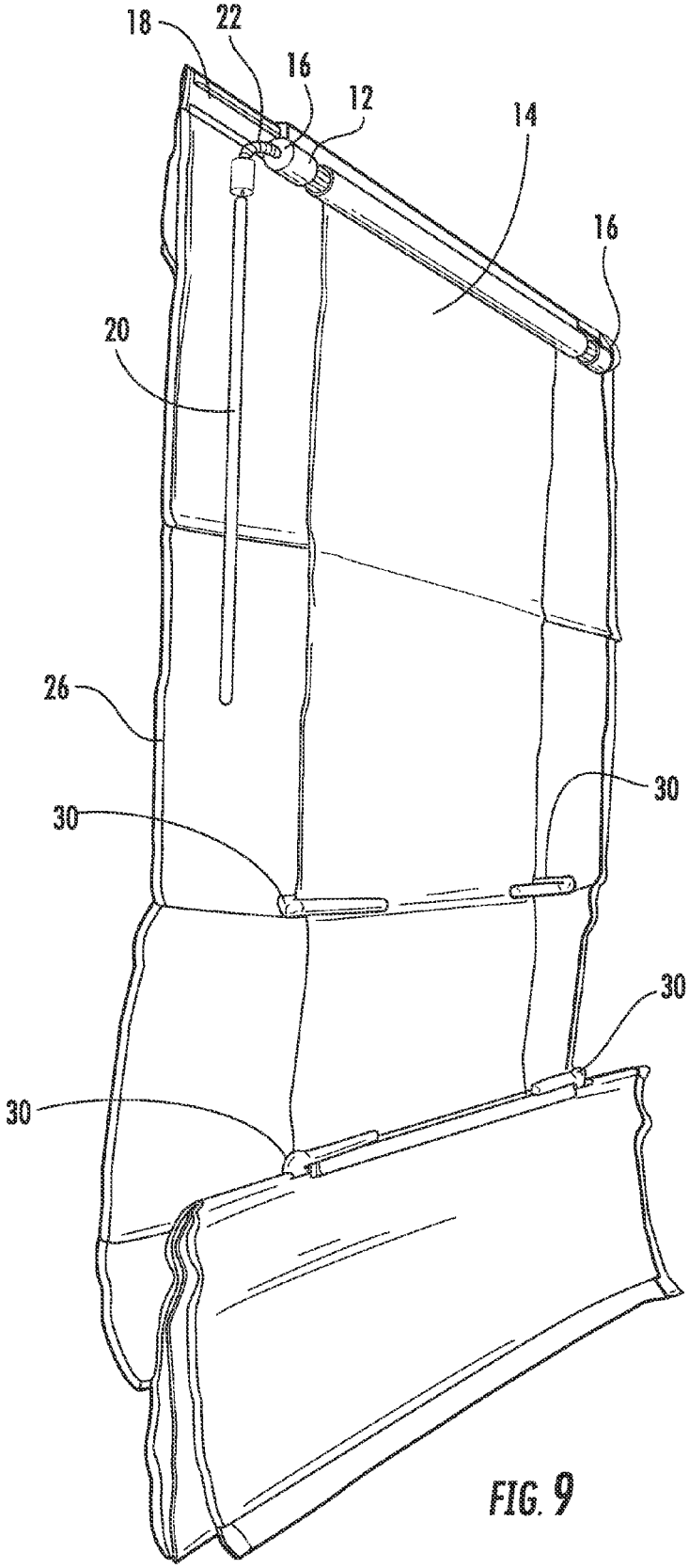
FIG. 9 is a rear perspective view of an embodiment of the cordless roll-up shade of the present invention with the decorative front panel partially rolled up.
Figure 10A:
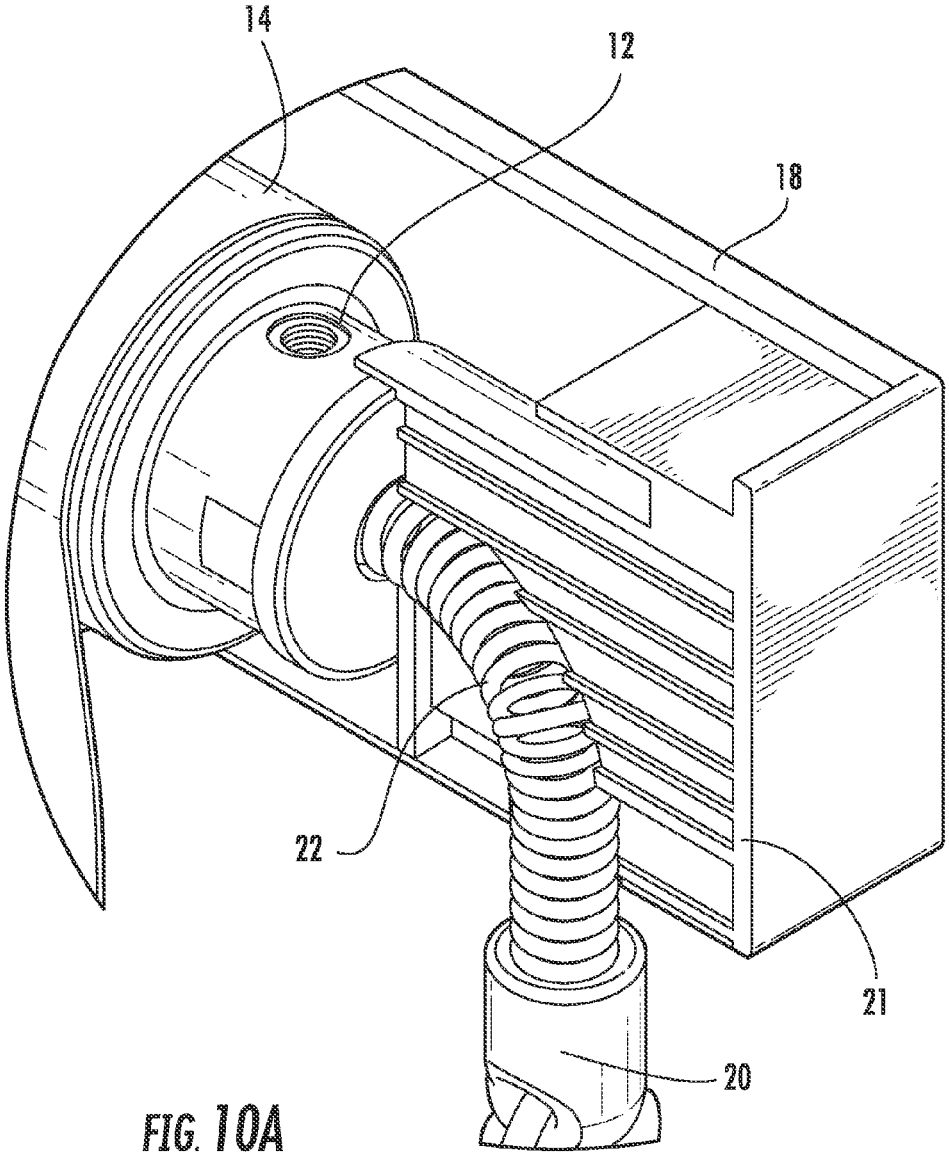
FIG. 10A is a partial cross-section view showing a preferred embodiment of a flexible shaft transmission shown with an optional guide block of the cordless roll-up shade of the present invention.

As shown in FIGS. 5, 6, 7, 8 and 9, wand 20 is configured to drive the shade rod 12 through a linkage or transmission. An operator rotates the wand 20 to raise and lower the back panel 14 by winding and unwinding it about the shade rod. In one embodiment, a flexible shaft 22 (best seen in FIG. 10A), such as a spring or cable is used as a transmission or linkage to connect the wand 20 to the shade rod 12. However, a universal joint would also function as well (as seen in FIG. 10D at 24). The flexible shaft 22 translates or links the rotational movement of the wand 20 into rotational movement of the shade rod 12, which in turn raises or lowers the back panel 14 wound about the shade rod 12 as shown in FIGS. 8 and 9. The shade rod 12, back panel 14, wand 20 and flexible shaft 22 (or other transmission 24, 38, 40) form the lifting assembly to raise and lower the decorative front panel 26. As shown in FIG. 7, wand 20 may comprise two articulated parts 20*a*, 20*b*.

As described further below in the alternative embodiments (shown in FIGS. 10B-10D), a different type of transmission or gearbox may also be used to translate the rotational movement of the wand 20 into rotational movement of the shade rod 12 also. Additionally, a guide block 21 (best seen in FIG. 10A) may be provided to orient the flexible shaft 20 downwards and parallel to the back panel 14 to prevent the wand 20 from wandering.

Referring again to FIGS. 1-4, decorative front panel 26 may be suspended from the head rail 18. Alternatively the front panel 26 may be suspended from the window opening in front of the shade rod 12 by one or more fasteners. The front panel 26 has a front face and a rear face. The rear face of the front panel 26 is that which is oriented toward the window sash 33. In a preferred embodiment, the front panel 26 is in the form of a Roman shade. The front panel 26 may also be formed as a mini-blind or roll-up shade. Additionally, the front panel 26 may also be made of a number of different materials as is known in art, such as cloth, fabric, polyester, nylon, plastic, vinyl, and bamboo. The front panel 26 may also include a privacy liner or blackout liner.

In the case of a Roman shade, the front panel 26 is formed from a number of sections having a pleat formed between each section. Extending from the rear face of the front panel 26 at each pleat is a pair of inwardly facing hooks or guides 30 that guide the front panel 26 (best seen in FIGS. 6 and 7) along the back panel 14. As the back panel 14 is rolled up on shade rod 12, the guides 30 cause folds to be formed in the front panel 26 as shown in FIGS. 8 and 9. The back panel 14 is secured near the bottom of the front panel 26 with fasteners, such as hook and loop or buttons, for instance. Alternatively, the back panel 14 may be anchored to the bottom-most pair of guides 30 on the front panel 26. The guides 30 may be formed as a unitary wire loop, wire hooks, or a cloth pocket may also be used. Additionally a unitary rod may be used as a guide 30 as well.

A head rail 18 may be used to suspend the shade rod 12 and the front panel 26 at window opening rather than fastening the brackets 16 directly to the inward facing portions of frame which define or bound the window opening. As shown in FIGS. 1-4, however, it is preferable that the head rail 18 is supported by the support assembly set in the recess of window opening, which permits the use of a hybrid mounting assembly described further below in FIGS. 5A-5E. Specifically the bearing blocks 15 combine with a head rail support member 34, described further below.

The front panel 26 may be suspended from the head rail with fasteners, such as hook and loop or buttons, for instance. The head rail 18 may be fastened to the window opening wall to suspend the cordless roll-up shade 10 thereto. An optional decorative valence 28 may be included to disguise the head rail 18 and hide the support assembly and lifting assembly.

A ratchet (not shown) may be included on one or both of the bearing blocks 13 to further reduce the risk of the cordless roll-up shade 10 from unfurling once it is rolled up. The ratchet includes a spring-biased plunger, or detent, that engages recesses on the tube end connector 15 to prevent the shade rod 12 from spinning loose freely.

Another aspect of the invention involves how the head rail is positioned relative to the window opening 32. FIGS. 5A-5E show preferred embodiments of a cordless roll-up shade 10 of the present invention which include a hybrid mounting assembly supporting a window treatment 36, such as a cordless roll-up shade of the present invention. However, it must be understood that the window treatment 36, may be mounted in another wall opening such as a doorway. Also, the window opening may or may not include a window frame. The hybrid mounting assembly of FIGS. 5B and 5C includes at least one support assembly, preferably two, such as the brackets 16 and the bearing blocks 15 described previously. The support assembly is attached to the topmost inward-facing structure portion 35, one of the four portions 35 which define the rectangular recess of the window opening 32. As shown, each inward-facing portion 35 runs perpendicularly from the front face 37 of window frame 32 to vicinity of sash 33.

With reference to FIGS. 5B and 5C, extending from the bearing blocks 15 is a head rail support member 34, which supports a head rail 18 that extends across the window and over left-right portions of the front face 37 of frame 32 which are adjacent the window opening 39. The head rail support member 34 extends forward of the inward facing structure portion 35 of the window opening, i.e., in a direction away from the sash 33, a minimal, yet sufficient, distance in order to keep the head rail 18 close to the vertical face 37 of frame 32 which it overlaps. Furthermore, the depth of the head rail 18 itself is small in order to minimize the distance that an attached window treatment 36 is spaced from the vertical face 37.

As described above, the window treatment 36 is supported by the head rail 18 and hangs down in front of the window. Because the head rail 18 extends wider than the width of the window opening, an operator can select a window treatment 36 that overlaps at least a portion of the frame 32 adjacent the window opening, thus blocking light. Because the head rail 18 is small in depth and has little projection from the plane of frame front face 37, and because the bearing blocks 15, head rail support member 34 and brackets 16 are mounted on the topmost inward-facing structure portion 35 of the frame 32 of the window opening, the window treatment 36 is kept nearly flush to the vertical face 37, which minimizes draft and light coming through the window opening. See FIGS. 5B and 5D.

As shown in FIG. 5B, the wand 20 and associated transmission elements, in particular flexible shaft 22, which serve to rotate shade rod 12 responsive to turning of the wand, are positioned in the space between the window sash 33 and the front panel 26 of window treatment 36, which space is of course also bounded by the four inward-facing wall portions 35. As described in connection with FIGS. 1-4, and as further described in connection with FIG. 9 and FIG. 13B, a window treatment 36 may comprise front panel 26 and associated lifting panel 14, also called back panel.

Figure 10B:
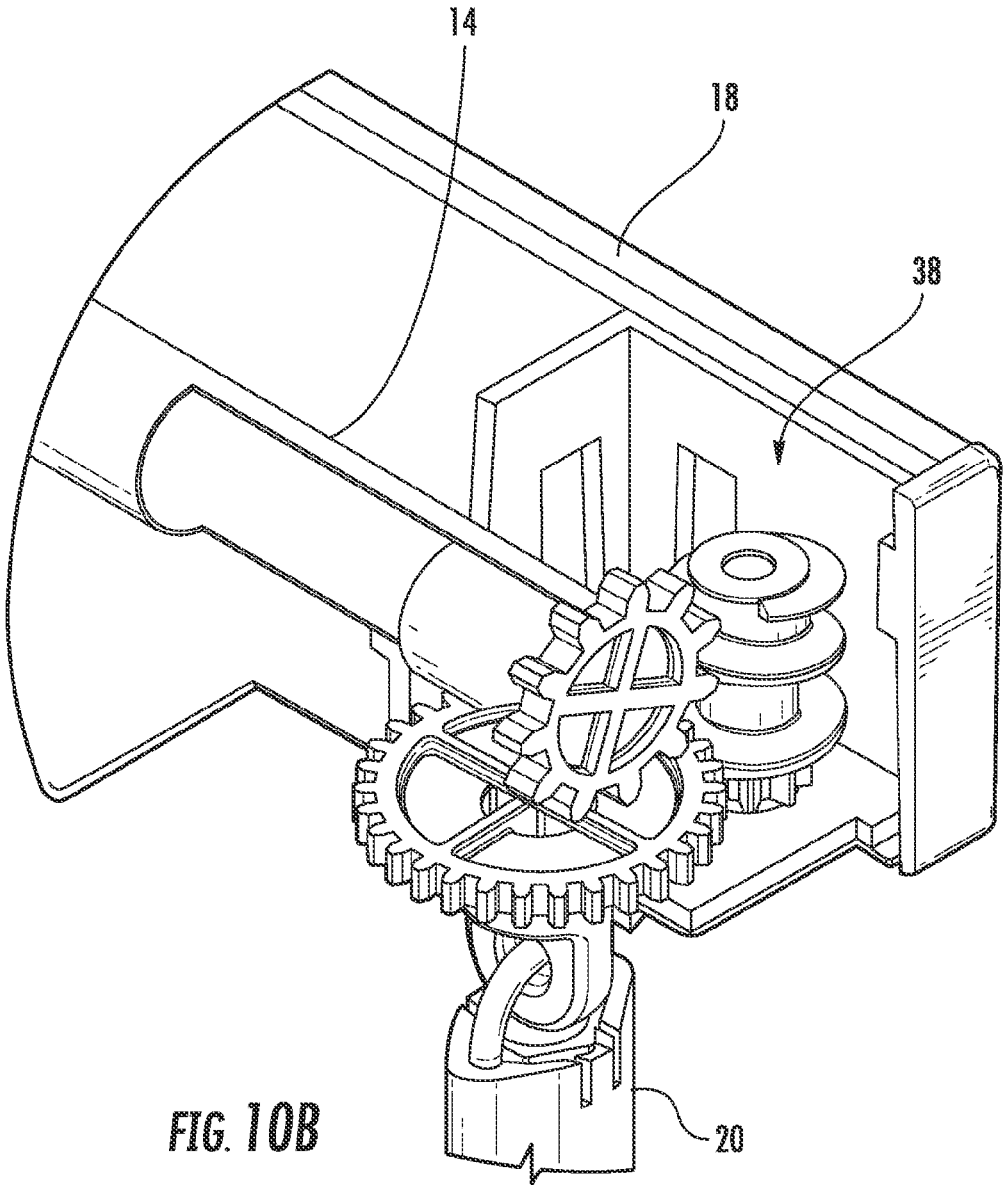
FIG. 10B is a partial cross-section view showing an alternative embodiment of a worm gear transmission of the cordless roll-up shade of the present invention.

Referring to FIG. 10B, in another embodiment a transmission including a worm gear 38 may be used to translate or communicate the rotational motion of the wand into the shade rod 12. The worm gear 38 has the added advantage of being self-locking, i.e. the cordless roll-up shade 10 will remain up or down in the position it was set by the operator and will resist slipping.

Figure 10C:
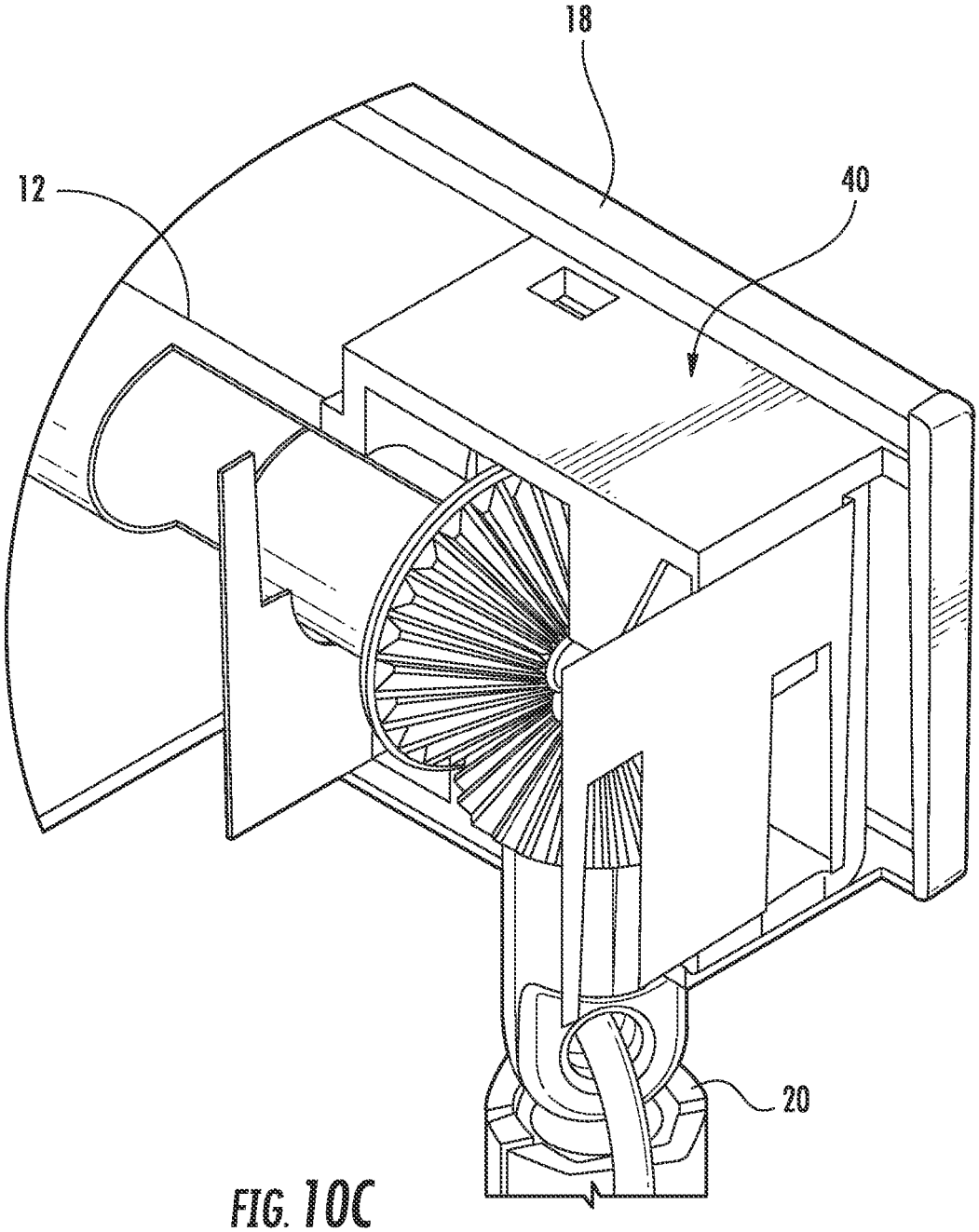
FIG. 10C is a partial cross-section view showing an alternative embodiment of a bevel gear transmission of the cordless roll-up shade of the present invention.
Figure 10D:
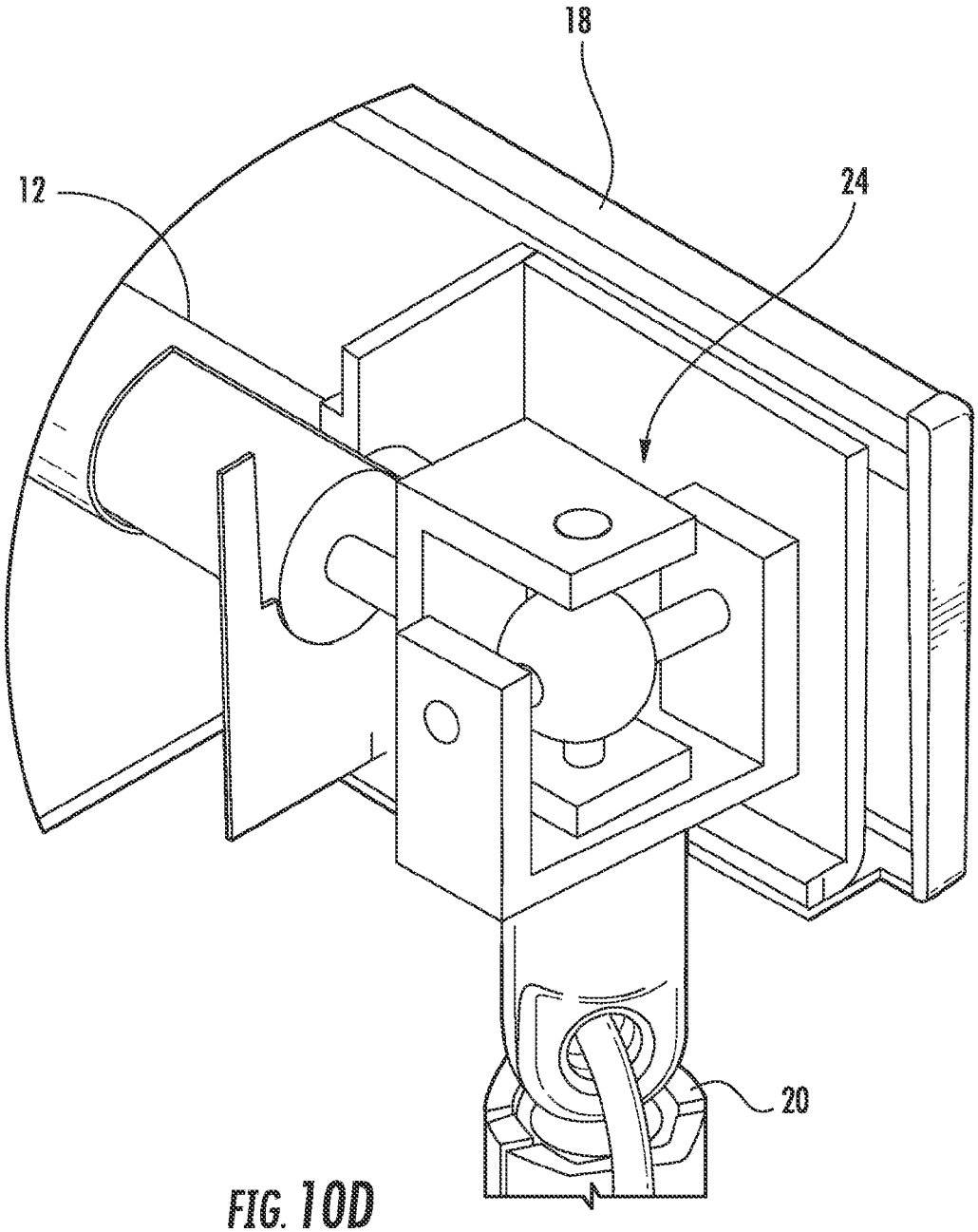
FIG. 10D is a partial cross-section view showing an alternative embodiment of a universal joint gear transmission of the cordless roll-up shade of the present invention.

Referring to FIG. 10C, in another embodiment a transmission includes a pair of bevel gears 40 may be used to translate or communicate the rotational motion of the wand 20 into the shade rod 12. Although a one-to-one ratio is shown, other ratios of the bevel gears 40 may be selected. The ratios of the bevel gears 40 may be selected as desired to control how fast or slow the back panel 14 of the present invention may be furled or unfurled by rotating the wand 20.

Referring to FIG. 10D, in another embodiment a transmission includes a universal joint 24 which may be used to translate the rotational motion of the wand 20 into the shade rod 12. The universal joint 24 also includes the advantage of being self-locking like the worm gear 38.

Figure 11A:
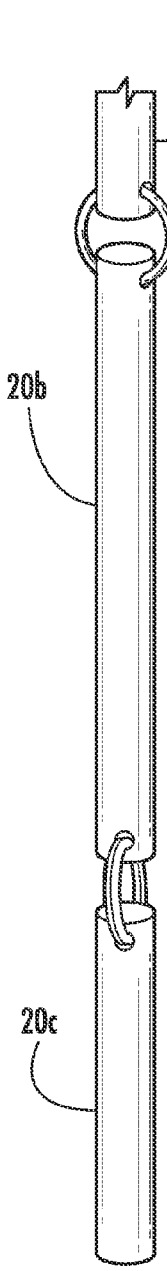
FIG. 11A is a partial front view of an alternative embodiment of a wand having three linked portions of the cordless roll-up shade of the present invention.
Figure 11B:
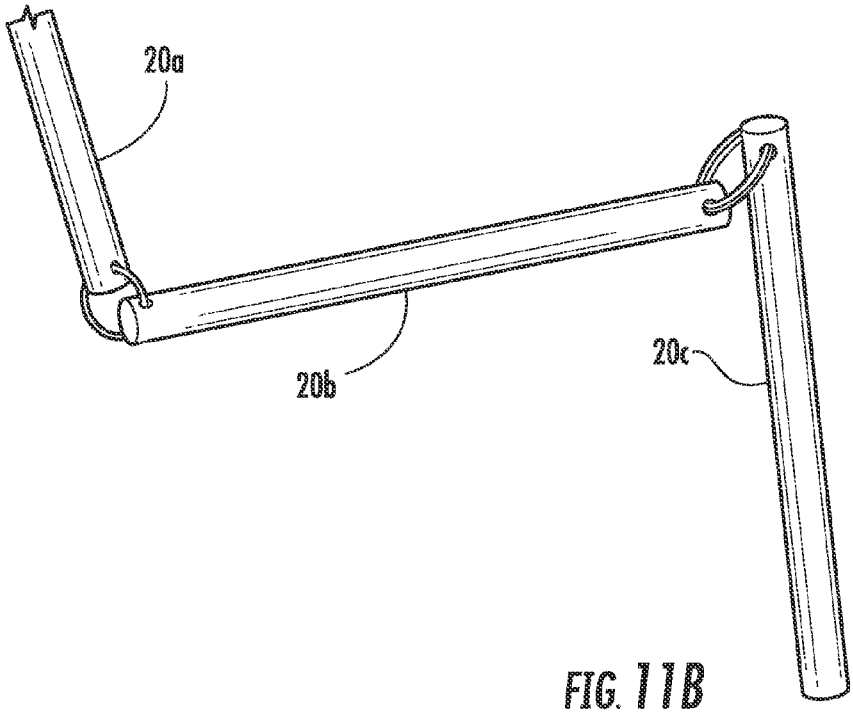
FIG. 11B is perspective view of an operator's hands aligning the three linked portions of the alternative embodiment of the wand into a crank.
Figure 11C:
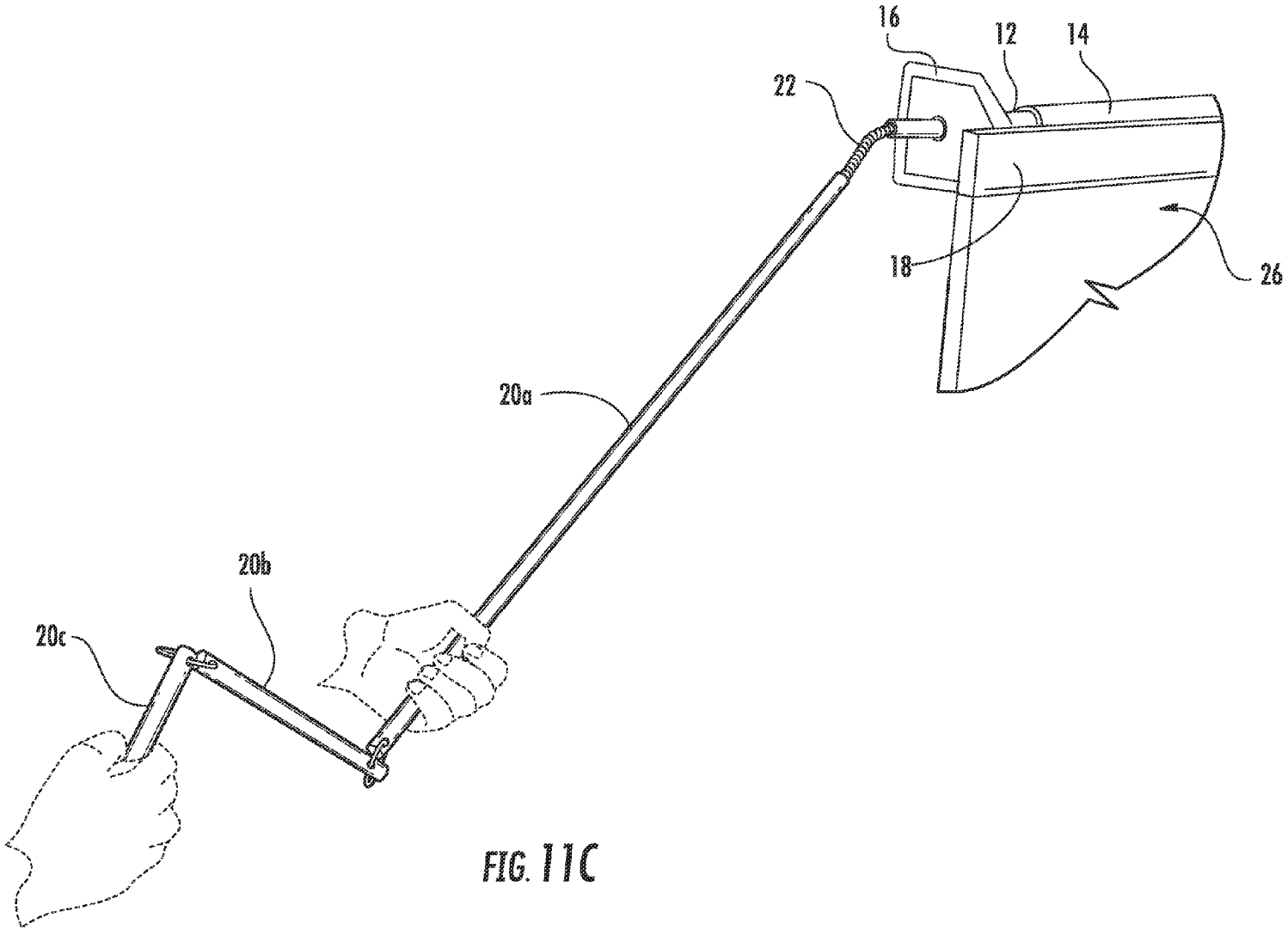
FIG. 11C is a perspective view of an operator using the three linked portions of the alternative embodiment of the wand articulated as a crank.

Referring to FIGS. 11A-11C, the wand 20 may include three jointed sections 20A-20C that permit the operator to form a crank. The crank allows the operator to easily rotate the wand 20 to raise and lower the cordless roll-up shade 10. Optionally, a wand 20 with two jointed sections may also be used to form a crank (best seen in FIGS. 7 and 13B).

Figure 12A:
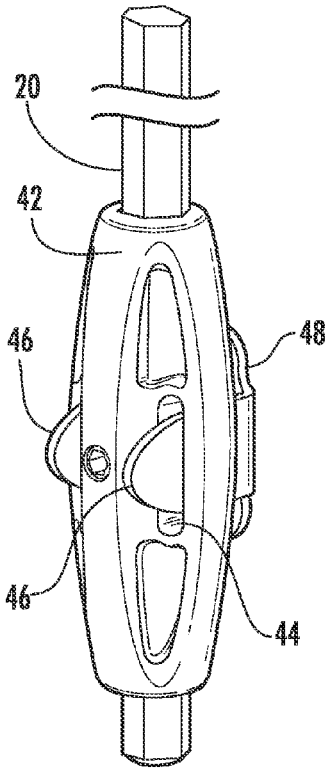
FIG. 12A is a close-up view of a first embodiment of the wand engaged on an anti-rotation cleat.
Figure 12B:
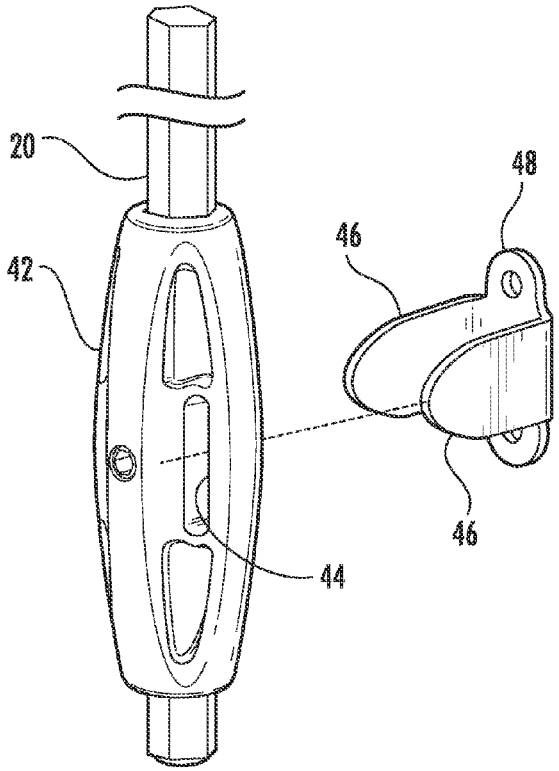
FIG. 12B is a close-up view of a first embodiment of the wand disengaged from the anti-rotation cleat.

Referring now to FIGS. 7, 12A, and 12B, the wand 20 may further include a grip 42 connected to the wand 20. The wand 20 is configured to attach to a window treatment adjustment mechanism, such as the transmissions illustrated in FIGS. 10A-10D, in order to raise or lower the window treatment or, alternatively in another application, adjust the pitch of the window treatment (e.g. mini-blinds). Rotating the wand 20 engages the window treatment adjustment mechanism.

The grip 42 includes at least one engagement surface 44, such as an aperture through the grip 42 that is configured to releasably couple to a reciprocal mating surface, such as a prong 46, of a cleat 48. The cleat 48 is further configured and arranged to be fixedly secured to a surface, such as a wall or window opening, to prevent the cleat 48 from moving. Preferably the cleat 48 includes two prongs 46, but may have a single prong 46 or a number of prongs 46 to engage the grip 42. The grip 42 is preferably configured to include the same number of engagement surfaces 44 as prongs 46 on the cleat 48, but more (or fewer) engagement surfaces 44 may be provided.

Figure 13A:
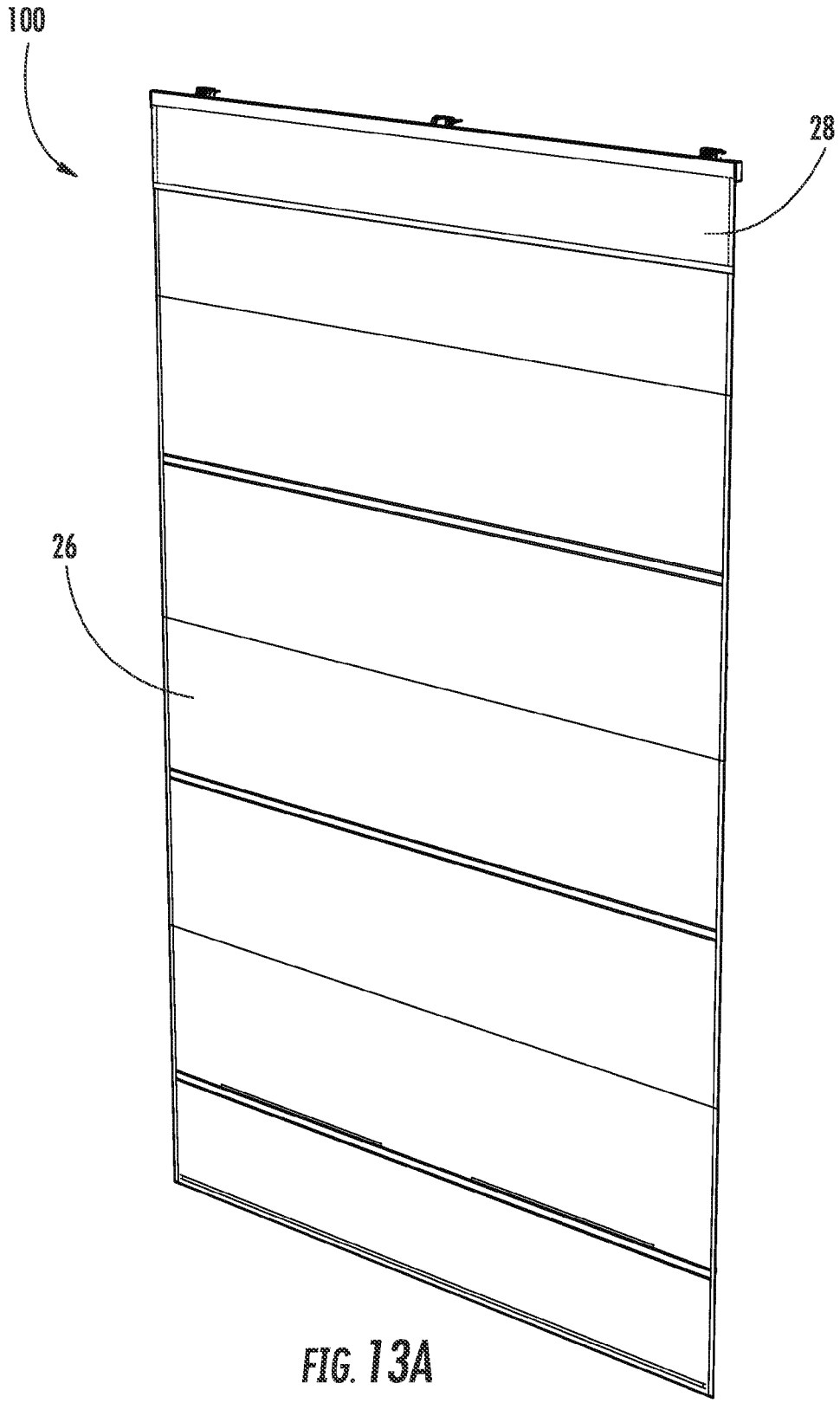
FIG. 13A is a front perspective view of an alternative embodiment of the cordless roll-up shade of the present configured for larger window openings.
Figure 13B:
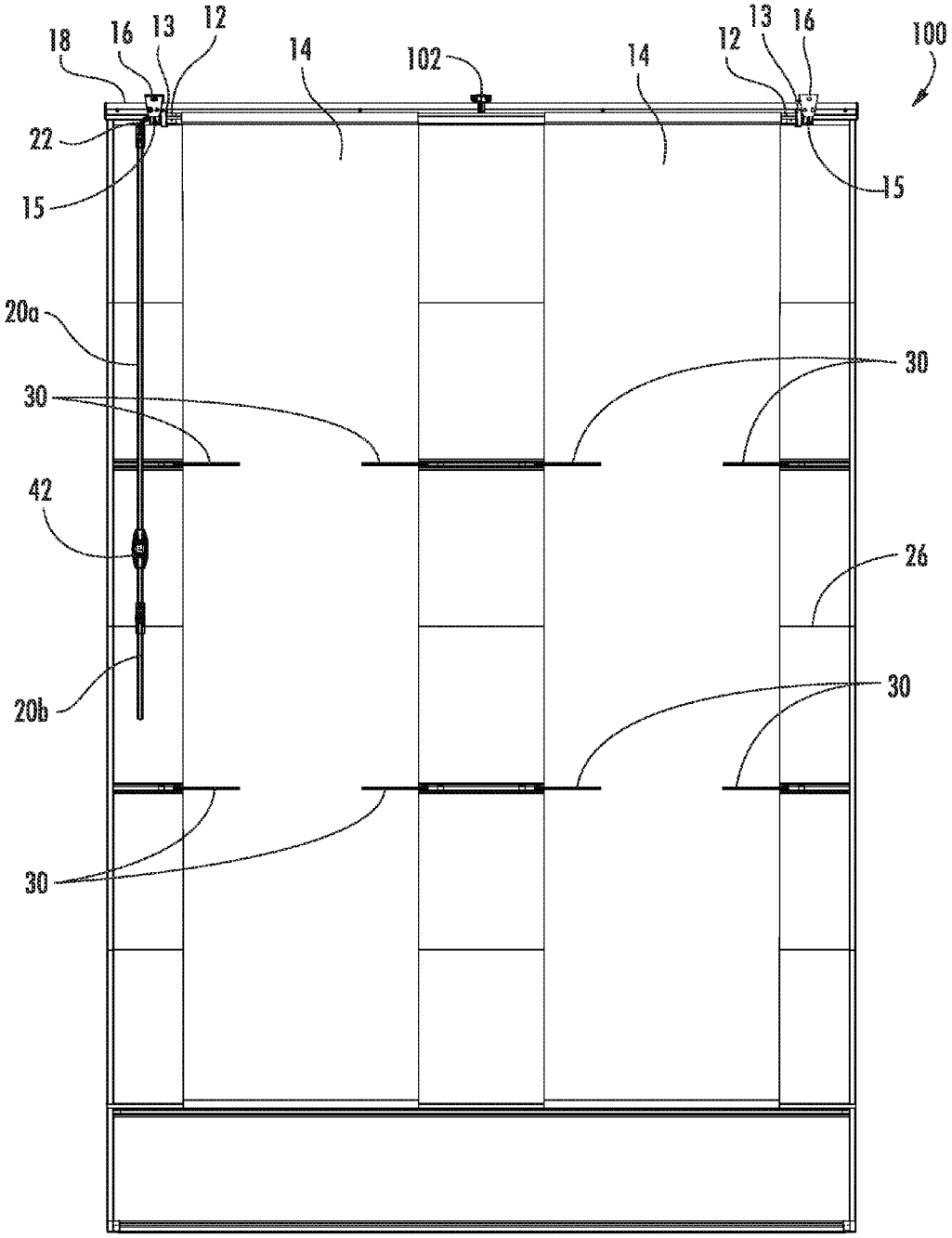
FIG. 13B is a rear view of an alternative embodiment of the cordless roll-up shade of the present invention showing the use of multiple roll-up shades.

Referring now to FIGS. 13A and 13B, an alternative embodiment of the cordless roll-up shade of the present invention is shown generally at 100. The alternative embodiment 100 includes two back panels 14, or lifting members, and associated guides 30, to raise and lower the front panel 26. The alternative embodiment 100 may include additional support assembly components such as a center support member 102, configured and arranged to further support the shade rod 12 and/or head rail 18. Optionally, the alternative embodiment 100 may include additional support assembly components, such as bearing blocks 13 and brackets 16, and multiple shade rods 12 and tube end connectors 15 as well to support additional bank panels 14. As can be seen the alternative embodiment is useful for covering wide window openings. As described previously, the width of the roll-up shades 14 may be selected to be sufficiently wide to avoid known strangulation hazards.

Therefore, it can be seen that the present invention provides a unique solution to the problem of providing a window treatment that does not use cords to raise and lower the window treatment, such as a Roman shade. Specifically, embodiments of the cordless roll-up shade of the present invention uniquely include a take up member, such as a shade rod, configured to gather a back panel, which raises or lowers a front panel. Also, the cordless roll-up shade of the present invention uniquely provides for a transmission or linkage for converting rotational movement on a wand into rotational movement on a take up member, such as a shade rod, to raise and lower and window treatment.

Furthermore, it can be seen that the present invention provides a unique solution to the problem of providing a method of mounting a window treatment in a window opening that permits the window treatment to overlap the sides of the window opening like an outside mount, yet is nearly flush with the window opening like an inside mount. The unique support assembly and head rail configuration of the hybrid mount of the present invention permit a window treatment that is wider than the window to be mounted nearly flush with the face of the window opening frame or wall, by having a support assembly mount on the inwardly-facing portion of the window opening. Similarly, a head rail that is wider than the window opening may be used to support the upper end of the window treatment, permitting a nearly flush mount of a window treatment to the head rail and face of the frame or wall of the window opening.

Also, it can be seen that the present invention provides a unique solution to the problem of providing a handle with an anti-rotation mechanism suitable for adjusting a window treatment by providing a wand with a grip that engages prongs on a cleat.

It will be appreciated by those skilled in the art that various changes and modifications can be made to the illustrated embodiments without departing from the spirit of the present invention. All such modifications and changes are intended to be within the scope of the present invention except insofar as limited by the appended claims.

What is claimed is:

1. A shade assembly, for selectively covering a window opening in a vertical wall having an inside surface, wherein a frame defines said opening and wherein a sash is positioned within said opening, the frame having a vertical inside face which is spaced apart from said sash and is parallel to said wall inside surface, the frame having a height and width, each bounded by opposing inward-facing frame portions, which shade assembly comprises:

(a) a support assembly, attached to one or more of said inward-facing frame portions proximate the top of said frame and positioned within said frame opening, having a length no greater than the width of said opening;

(b) a head rail, attached to the support assembly and running horizontally, having a horizontally extending dimension which is greater than the width of said opening and sufficient to overlap opposing vertical sides of said frame inside face, the head rail contacting or minimally spaced apart from said inside frame face;

(c) a lifting assembly, attached to the support assembly and positioned within said opening, extending a horizontal width distance which is less than the width of said opening, the lifting assembly comprising a horizontally disposed rod for rotatably furling and unfurling a lifting panel;

(d) a window treatment comprised of a front panel and a lifting panel, wherein i. the front panel has a width which is greater than the width of said opening, an upper end attached to the head rail, and a lower end which can be selectively lowered and raised for covering and uncovering the window opening, the front panel in lowered position being closely positioned to said inside frame face;

ii. the lifting panel has a width which is less than the width of said opening, an upper end connected to said rod for furling and unfurling thereon, and a lower end attached to the lower end of the front panel; and, (e) a transmission for rotating said rod, to alternately furl and unfurl the lifting panel thereon and thereby raise and lower the lower end of the front panel;

wherein, the lifting assembly and transmission are positioned within the space between the lifting panel and said sash when the front panel is in a lowered position where the window opening is covered.

2. The shade assembly of claim 1 wherein said transmission comprises a combination of flexible shaft and wand.

3. The shade assembly of claim 1 wherein said transmission comprises a combination of knuckle joint and wand.

4. The shade assembly of claim 1 wherein the support assembly comprises one or more brackets.

5. The shade assembly of claim 4 wherein the brackets are spaced apart horizontally and attached to the inward-facing frame portion which bounds the top of the opening.

6. The shade assembly of claim 4 further including a bearing block associated with each bracket.

7. The shade assembly of claim 1 wherein said support assembly projects a small distance beyond the plane of said vertical frame inside face.

8. A shade assembly, for selectively covering a window opening in a vertical wall having an inside surface, wherein a frame defines said opening and wherein a sash is positioned within said opening, the frame having a vertical inside face which is spaced apart from said sash and is parallel to said wall inside surface, the frame having a height and width, each bounded by opposing inward-facing frame portions, which shade assembly comprises:

(a) a head rail, running horizontally, attached to said inside face of the frame at the upper end thereof, and having a horizontally extending dimension which is greater than the width of said opening and sufficient to overlap opposing vertical sides of said frame inside face;

(b) a lifting assembly, set within said opening, attached to one or more of the inward-facing frame portions near the top of the opening, extending a horizontal width distance which is less than the width of said opening, the lifting assembly comprising a horizontally disposed rod for rotatably furling an unfurling a lifting panel;

(c) a window treatment comprised of a front panel and a lifting panel, wherein i. the front panel has a width which is greater than the width of said opening, an upper end attached to the head rail, and a lower end which can be selectively lowered and raised for covering and uncovering the window opening, the front panel in lowered position being closely positioned to said inside frame face;

ii. the lifting panel has a width which is less than the width of said opening, an upper end connected to said rod for furling and unfurling thereon, and a lower end attached to the lower end of the front panel; and, (d) a transmission for rotating said rod, to alternately furl and unfurl the lifting panel thereon and thereby raise and lower the lower end of the front panel;

wherein, the lifting assembly and transmission are positioned within the space between the lifting panel and said sash when the front panel is in a lowered position where said window opening is covered; and, wherein the head rail is shaped so that the front panel attached thereto is close to said vertical frame inside face, to impede passage of light and movement of air through the space.

9. The shade assembly of claim 8 wherein said transmission comprises a combination of flexible shaft and wand.

10. The shade assembly of claim 8 wherein said transmission comprises a combination of knuckle joint and wand.

* * * * *